US012038223B2

(12) United States Patent
Hu et al.

(10) Patent No.: US 12,038,223 B2
(45) Date of Patent: Jul. 16, 2024

(54) METAL MEMBER FOR HOUSEHOLD APPLIANCE AND HOUSEHOLD APPLIANCE

(71) Applicant: BSH HAUSGERAETE GMBH, Munich (DE)

(72) Inventors: Chenli Hu, Nanjing (CN); Jiajia Ma, Nanjing (CN); Dawei Mi, Nanjing (CN); Kai Wang, Taiyuan (CN); Yvonne Janet Weisbarth, Gruenwald (DE); Yi Wen, Nanjing (CN); Rong Zeng, Nanjing (CN); Qiang Zhang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 458 days.

(21) Appl. No.: 17/356,655

(22) Filed: Jun. 24, 2021

(65) Prior Publication Data

US 2022/0018592 A1 Jan. 20, 2022

(30) Foreign Application Priority Data

Jul. 14, 2020 (CN) ..... 202021380993

(51) Int. Cl.

| | |
|---|---|
| ***F25D 23/02*** | (2006.01) |
| ***A47L 15/42*** | (2006.01) |
| ***D06F 39/14*** | (2006.01) |
| ***F24C 15/02*** | (2006.01) |
| ***F25D 27/00*** | (2006.01) |

(52) U.S. Cl.

CPC ..... *F25D 23/028* (2013.01); *A47L 15/4257* (2013.01); *D06F 39/14* (2013.01); *F24C 15/024* (2013.01); *F25D 27/00* (2013.01); *F25D 2327/001* (2013.01)

(58) Field of Classification Search

CPC ... A47L 15/4265; A47L 15/4257; B44C 5/00; B44C 5/02; B44C 1/105; C25F 7/00; C25F 3/02; C25F 3/16; C25F 3/20; D06F 39/14; F25D 23/028; F25D 23/02; F25D 2400/18; F25D 27/00; F25D 327/001; F24C 15/024; G02B 6/0051

USPC ..... 312/204; 52/312

See application file for complete search history.

(56) References Cited

U.S. PATENT DOCUMENTS

| | | | | |
|---|---|---|---|---|
| 2,236,904 | A * | 4/1941 | Hendrickson | B44C 5/04 312/204 |
| 2,842,420 | A * | 7/1958 | Hansen | A47B 88/944 D6/705.5 |
| 4,274,237 | A * | 6/1981 | Hagstrom | B44C 5/00 D15/74 |
| 5,444,956 | A * | 8/1995 | Searer | E04F 19/02 52/312 |
| 9,746,765 | B2 * | 8/2017 | Choi | C25F 3/20 |
| 2010/0320890 | A1 * | 12/2010 | Jung | F25D 27/00 312/405 |
| 2020/0056832 | A1 * | 2/2020 | Snyder | F25D 27/005 |

* cited by examiner

*Primary Examiner* — William D Hutton, Jr.
*Assistant Examiner* — Carl J Carlson
(74) *Attorney, Agent, or Firm* — Laurence A. Greenberg; Werner H. Stemer; Ralph E. Locher

(57) ABSTRACT

A metal member for a household appliance includes a first surface and a second surface connected to each other. The second surface is inclined with respect to the first surface, and the second surface has a reflectivity higher than that of the first surface. A household appliance having the metal member is also provided.

18 Claims, 5 Drawing Sheets

METAL MEMBER FOR HOUSEHOLD APPLIANCE AND HOUSEHOLD APPLIANCE

CROSS-REFERENCE TO RELATED APPLICATION

This application claims the priority, under 35 U.S.C. § 119, of Chinese Patent Application CN 202021380993.7, filed Jul. 14, 2020; the prior application is herewith incorporated by reference in its entirety.

BACKGROUND OF THE INVENTION

Field of the Invention

The invention relates to the field of household appliances, and in particular, to a metal member for a household appliance and a household appliance including the metal member.

Household appliances have become indispensable necessities in modern family life. Requirements of users for household appliances are no longer limited to the implementation of basic functions, and appearance is also an important factor that users take into consideration when purchasing household appliances. In addition, the rapid growth of household appliances brings a heavy energy consumption, and consequently aggravates environmental pollution. Therefore, the consideration of how to reduce the energy consumption of household appliances is also a technical problem to be considered in the process of manufacturing household appliances.

BRIEF SUMMARY OF THE INVENTION

It is accordingly an object of the invention to provide a metal member for a household appliance and a household appliance, which overcome at least one of the hereinaforementioned disadvantages and technical problems of the heretofore-known metal members and appliances of this general type.

With the foregoing and other objects in view there is provided, in accordance with the invention, a metal member for a household appliance. The metal member includes a first surface and a second surface connected to each other. The second surface is inclined with respect to the first surface, and the second surface has a reflectivity higher than that of the first surface.

This configuration provides a metal member for a household appliance to improve the sense of quality of the household appliance. When light is irradiated on the surface of the metal member, the light is reflected by the second surface to provide a bright light effect. This can provide a decorative effect, making the appearance of the household appliance more stunning and eye-catching when irradiated by light. The above configuration may utilize environmental light, such as natural light, or an indoor lamp, to achieve a bright light effect without consuming electrical energy, thereby conserving energy.

In addition, the above configuration can be used for reminding users. The configurations of some functional components, for example, a hidden handle, of the household appliance, are relatively concealed, and the bright light effect provided by the above configuration can be used for showing the positions of these functional components, allowing the user to operate these functional components quickly and correctly.

The metal member of this embodiment is an integral part, which may be made of aluminum, a stainless steel, or other metal materials.

In one or more possible embodiments, the metal member includes a groove extending along a length direction of the metal member, and the second surface is located in the groove. Therefore, when light is irradiated on the metal member, a bright line or strip is formed on the surface of the household appliance, which produces a visual contrast and a high directionality and can be used for providing a directional indication, for example, the bright line or strip may point to a mark or a hidden functional component.

In one or more possible embodiments, the second surface includes two sub-surfaces in mirror symmetry with each other. Therefore, light reflected by one of the two sub-surfaces at least partially arrives at the other sub-surface, thereby further enhancing the produced bright light effect.

In one or more possible embodiments, a cross section of the groove is V-shaped.

In one or more possible embodiments, an angle formed between the two sub-surfaces is 120°. If the angle formed between the two sub-surfaces is too small, the user is likely to be injured by the sharp edge of the groove. However, if the angle formed between the two sub-surfaces is too large, the area with the bright light effect is too wide or large and eye-catching, which may weaken the effect of indicating the position that the bright light effect is intended to indicate or show. Therefore, in one or more possible embodiments, a width of the groove is 3.5±0.15 mm.

In one or more possible embodiments, the metal member includes a mark disposed on the first surface, and the mark is disposed on one side of an end of the groove so that the groove extends toward the mark. The mark may be a functional mark, such as a word "open" or an indicator arrow, allowing the user to operate or control according to the prompt. The mark may also be a brand logo or an image logo. This improvement helps enhance the brand identity.

In one or more possible embodiments, the second surface extends in an edge area of the metal member along a length direction of the metal member, so as to reduce the possibility that the first surface blocks the light from arriving at the second surface.

In one or more possible embodiments, the reflectivity of the second surface is equal to or close to a reflectivity of a mirror surface. Therefore, a better light reflecting effect is obtained, thereby providing a brighter metal member under the same light irradiation condition. Furthermore, processing the second surface to a reflectivity that is equal to or close to the reflectivity of a mirror is the highest level of metal processing, and helps improve the sense of quality of the product.

In one or more possible embodiments, surface roughness of the second surface is less than surface roughness of the first surface. In particular, the surface roughness of the second surface is not greater than 0.4 μm, and the surface roughness of the first surface is greater than 0.1 mm. Because of a very high flatness and a high surface smoothness, the second surface has a higher light reflectivity so that a bright light effect is obtained when light is irradiated on the metal member. Furthermore, the difference between the surface roughness of the first surface and the surface roughness of the second surface leads to a difference in reflectivity to light, producing a visual contrast that makes the bright light effect more prominent, thereby providing a more prominent indication or prompting effect.

In one or more possible embodiments, the first surface is a surface having a line pattern formed by a metal wire drawing process, and/or the second surface is a surface formed by metal cutting. Therefore, the metal member may present a sense of quality of precision processing, which, when used in a household appliance, can improve the sense of quality and precision of the household appliance.

It is to be noted that the formation of the first surface is not limited to the metal wire drawing process, and the formation of the second surface is not limited to the metal cutting step, but instead, the first surface and the second surface may also be formed by other steps or processes, such as heat treatment or anodic oxidation.

In one or more possible embodiments, the metal member is elongated, the first surface extends along an entire length of the metal member, and the second surface extends along an entire or partial length of the metal member.

With the objects of the invention in view, there is also provided a household appliance, including the metal member of any one of the above embodiments.

In the embodiments of the invention, the household appliance may be one or more appliance of a refrigerator, a dishwasher, a cooker hood, a washing machine, a gas cooktop, and an induction cooktop.

In one or more possible embodiments, the household appliance includes a panel located in the front of the household appliance, the metal member is disposed on an edge area of the panel, and the metal member extends along at least one edge of the panel. Therefore, the configuration of the metal member may not damage the integrity of the panel, and reduce the decrease in the strength of the panel. For example, the panel is made of glass. This configuration may not damage the glass, so as to maintain the integrity of the entire glass. Even if the panel needs to be cut, the cutting is carried out at an edge of the panel, which facilitates the processing and minimizes the impact on the strength of the panel.

In one or more possible embodiments, the panel has a notch matching an outer contour of the metal member, and the metal member is embedded in the notch. That "the metal member is embedded in the notch" described herein should be understood as that the metal member fills up at least part of the notch to make an outer contour of the panel more intact than that before the embedding.

In one or more possible embodiments, the first surface extends in a direction perpendicular to a horizontal plane, and the second surface is inclined backward from the first surface.

In one or more possible embodiments, the first surface extends in a direction perpendicular to a horizontal plane, and the second surface is inclined backward and upward from the first surface. The household appliance is placed indoors and common indoor light is from a ceiling-mounted lamp indoor which irradiates light from top to bottom. Therefore, the construction where the first surface extends vertically and the second surface is inclined backward and upward from the first surface is more favorable for the second surface to reflect indoor light irradiated from top to bottom, thereby providing a better bright light effect.

In one or more possible embodiments, the first surface is flush with a front surface of the panel, or the first surface slightly projects from the front surface of the panel. In this way, the household appliance has a relatively flat surface.

In one or more possible embodiments, the household appliance further includes a light emitting module, where the metal member is disposed close to the light emitting module so that the second surface is adapted for reflecting light emitted from the light emitting module. Therefore, the second surface is brighter, providing a decoration, indication or prompting effect.

It is to be noted that, the light emitting module may be a single light source such as an LED. In some embodiments, components included in the light emitting module are not limited to a light source, for example, the light emitting module includes a light source, a light guide member and a light transmission portion. Light of the light emitting module is finally emitted from the light transmission portion. In this case, that "the metal member is disposed close to the light emitting module" should be understood as that the metal member is disposed close to the light transmission portion. In any case, that "the metal member is disposed close to the light emitting module" should be understood as that the metal member is disposed close to a component from which the light is finally emitted in the light emitting module.

In one or more possible embodiments, the second surface is closer than the first surface to the light emitting module. This helps improve the brightness and reduce the possibility that the first surface blocks the light from arriving at the second surface.

In one or more possible embodiments, the household appliance includes a first door and a second door adjacent to each other, where the metal member is disposed along a side of the first door close to the second door, the second door is provided with a light emitting module on a side thereof close to the first door, and the second surface is closer than the first surface to the second door.

The above configuration not only facilitates the configuration of the light emitting module and the layout of circuit, but also reduces the impact of the configuration of the light emitting module on the construction of the door body, particularly on foaming of the door body. In addition, the above configuration can increase the brightness of the second surface, and reduce the possibility that light is blocked from arriving at the second surface.

In one or more possible embodiments, the household appliance includes a third door and a fourth door adjacent to each other, where one of the third door and the fourth door is configured to uncover or cover a refrigerating space, and the other one of the third door and the fourth door is configured to uncover or cover a freezing space; and the metal member is disposed along a side of the third door close to the fourth door, and the second surface is closer than the first surface to the fourth door.

Taking a refrigerator as an example of the household appliance, the metal member separates the refrigerator into different storage spaces, which are distinguished distinctly into a refrigerating space and a freezing space in terms of the visual effect, so that even if indoor light is not bright enough, a shining effect produced by the reflection of the second surface allows the user to better distinguish the refrigerating space and the freezing space, so as to take or place items rapidly and correctly.

In one or more possible embodiments, the household appliance includes a third door and a fourth door adjacent to each other, where a gap is formed between the third door and the fourth door, the metal member is disposed along a side of the third door close to the gap, and the second surface is closer than the first surface to the gap. The metal member visually functions as a separator between the third door and the fourth door. In addition, because the gap is formed between the third door and the fourth door and the gap forms a dark area, a visual contrast is produced between the dark area and the bright second surface, which makes the shining effect more prominent, making the user feel that the second surface is brighter, thereby providing a better prompting, indication or decoration effect.

In one or more possible embodiments, the household appliance includes a fifth door and a sixth door adjacent to each other, where the metal member disposed on the fifth door and a metal member disposed on the sixth door are flush with each other so that the second surfaces extend in the same direction.

In one or more possible embodiments, the household appliance includes a handle slot and a grip portion located on a front side of the handle slot, where the metal member is located at the grip portion and extends along the handle slot, and the second surface is closer than the first surface to the handle slot. On one hand, the metal member can improve the strength of the grip portion. On the other hand, the metal member can indicate the position of the grip portion.

In one or more possible embodiments, the household appliance includes a door, where the metal member is disposed on the door, the door extends along a vertical direction, and the metal member is disposed on a middle part and/or an upper part of the door. Therefore, a person standing near the household appliance can notice more easily the bright light effect formed by the light reflected by the second surface of the metal member.

Other features which are considered as characteristic for the invention are set forth in the appended claims. It is to be pointed out that, features of dependent claims may be combined with each other in any way and with features of independent claims without departing from the concept of the invention.

Although the invention is illustrated and described herein as embodied in a metal member for a household appliance and a household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

A detailed description is provided below in conjunction with embodiments, for a further understanding of the objectives, structures, features and functions of the invention.

Figure 1:
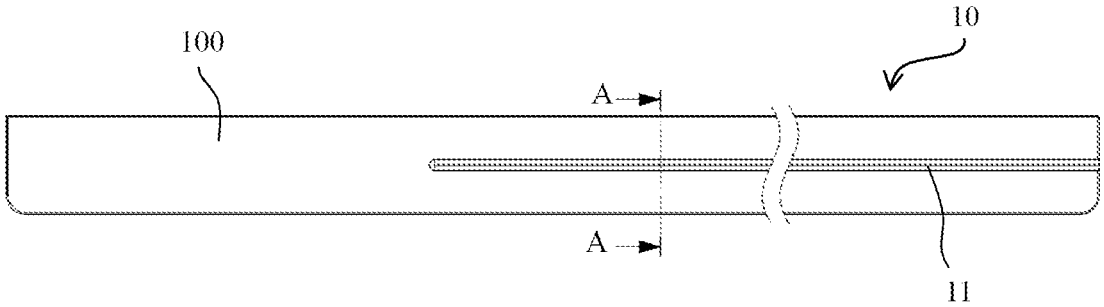
FIG. 1 is a diagrammatic, front-elevational view of a metal member according to an embodiment of the invention.
Figure 2:
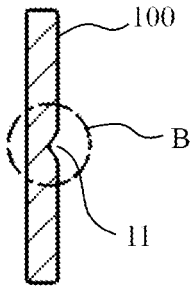
FIG. 2 is a cross-sectional view of FIG. 1 taken along a line A-A, in the direction of the arrows.
Figure 3:
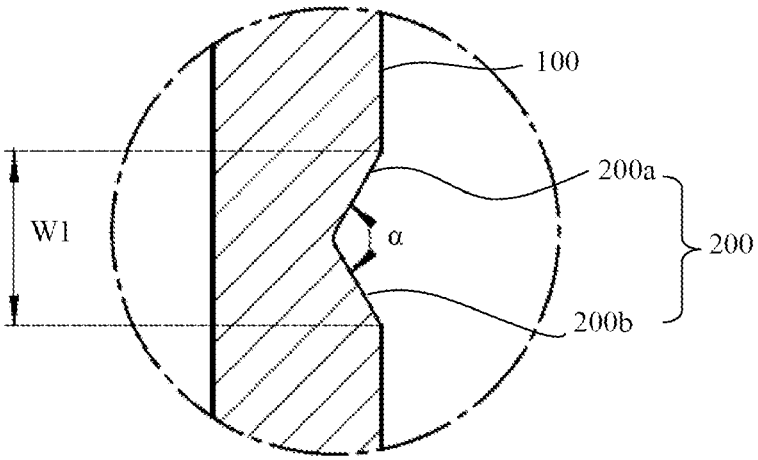
FIG. 3 is an enlarged view of an area B in FIG. 2.

Referring now to the figures of the drawings in detail and first, particularly, to FIGS. 1-3 thereof, it is seen that FIG. 1 is a front view of a metal member according to an embodiment of the invention; FIG. 2 is a cross-sectional view of FIG. 1 taken along a line A-A; and FIG. 3 is an enlarged view of an area B in FIG. 2.

This embodiment relates to a metal member 10 for a household appliance, including a first surface 100 and a second surface 200 connected to each other.

The second surface 200 is inclined with respect to the first surface 100, and the second surface 200 has a reflectivity higher than that of the first surface 100. The reflectivity of the second surface 200 is equal to or close to a reflectivity of a mirror surface, so as to reflect light irradiated on the metal member to provide the second surface 200 with a bright light effect, thereby achieving a bright light decoration effect similar to an electrified light source.

A surface roughness of the second surface 200 of the metal member 10 of this embodiment is less than a surface roughness of the first surface 100. The surface roughness of the second surface 200 is not greater than 0.4 μm, and the surface roughness of the first surface 100 is greater than 0.1 mm. In this embodiment, the surface roughness of the second surface 200 is 0.1 μm, and the surface roughness of the first surface 100 is 0.15 mm.

In this embodiment, the first surface 100 is a surface having a line pattern formed by a metal wire drawing process. The second surface 200 is a surface formed by metal cutting.

As shown in FIG. 1, the metal member 10 is elongated. The first surface 100 extends along an entire length of the metal member 10. The second surface 200 extends along a partial length of the metal member 10.

As shown in FIG. 2, the first surface 100 of this embodiment extends along a plane.

The metal member 10 of this embodiment includes a groove 11 extending along a length direction of the metal member 10, where the second surface 200 is located in the groove 11.

As shown in FIG. 3, the second surface 200 includes two sub-surfaces 200*a* and 200*b* in mirror symmetry with each other. An angle formed between the sub-surface 200*a* and the sub-surface 200*b* is 120°. The sub-surface 200*a* and the sub-surface 200*b* respectively extend along two planes. The two sub-surfaces are connected or close to each other so that the groove 11 is a groove having a V-shaped cross-section.

The metal member 10 of this embodiment is made of aluminum, and has a width of 30 mm. A width W1 of the groove 11 is 3.5 mm.

Figure 4:
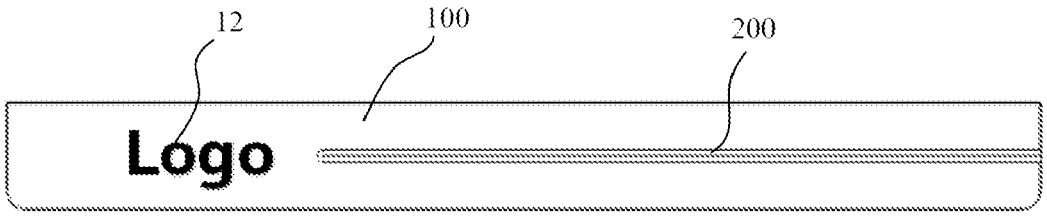
FIG. 4 is a front-elevational view of a metal member according to another embodiment of the invention.

Next, referring to FIG. 4, it is seen that FIG. 4 is a front view of a metal member according to another embodiment of the invention. Structures in this embodiment that are the same as or similar to those in the foregoing embodiment are denoted by same or similar reference numerals, and have the same or similar functions or effects, so that the details will not be repeated herein. A difference from the foregoing embodiment is that the metal member 10 of this embodiment further includes a mark 12 disposed on the first surface 100, where the mark 12 is shown as a "Logo" in FIG. 4. In fact, the mark 12 may be a trademark, a brand logo, a pattern, or the like. The mark 12 is disposed on one side of one end of the groove 11 so that the groove 11 extends toward the mark 12.

Figure 5:
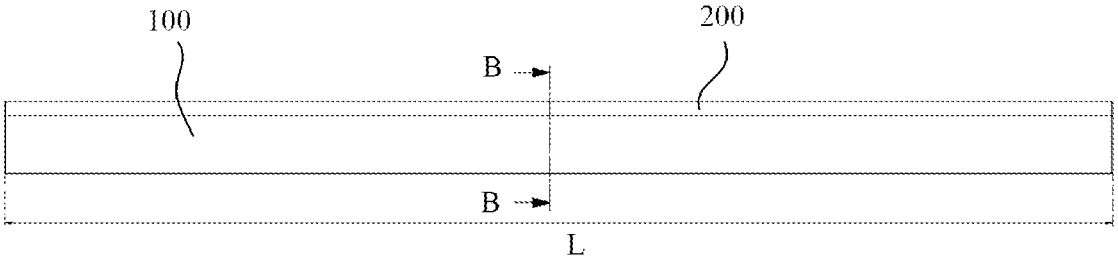
FIG. 5 is a front-elevational view of a metal member according to another embodiment of the invention.
Figure 6:
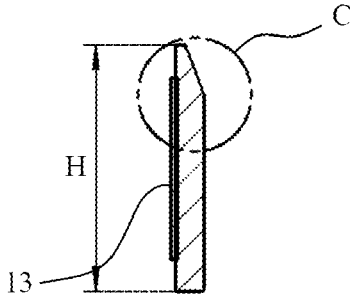
FIG. 6 is a cross-sectional view of FIG. 5 taken along a line B-B, in the direction of the arrows.
Figure 7:
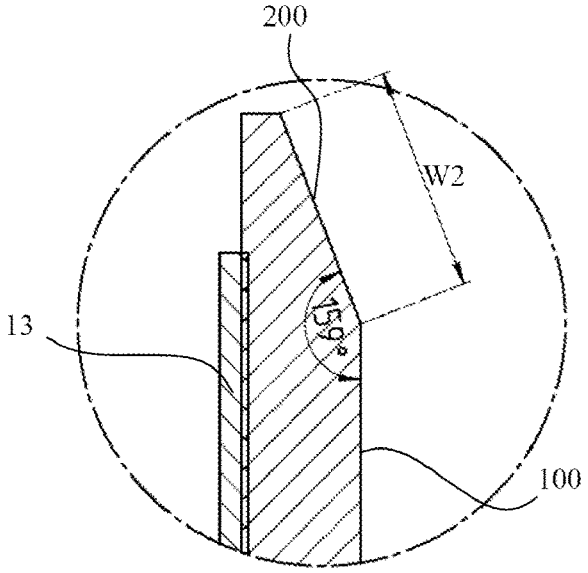
FIG. 7 is an enlarged view of an area C in FIG. 6.

Next, referring to FIG. 5 to FIG. 7, it is seen that FIG. 5 is a front view of a metal member according to another embodiment of the invention; FIG. 6 is a cross-sectional view of FIG. 5 taken along a line B-B; and FIG. 7 is an enlarged view of an area C in FIG. 6. Structures in this embodiment that are the same as or similar to those in the foregoing embodiment are denoted by the same or similar reference numerals, and have the same or similar functions or effects, so that the details will not be repeated herein. A difference from the foregoing embodiment, is that in this embodiment, the second surface 200 extends along the entire length of the metal member 10. Moreover, the second surface 200 extends in an edge area of the metal member 10 along the length direction of the metal member 10. The second surface 200 extends along a plane. An angle formed between the first surface 100 and the second surface 200 is 159°.

A width H of the metal member of this embodiment is 30 mm. A width W2 of the second surface 200 is 6.4 mm. Certainly, in another embodiment, the width of the metal member may also be 20 mm.

The metal member 10 of this embodiment is disposed on a surface of the household appliance by pasting. As shown in FIG. 6 and FIG. 7, a surface of the metal member opposite to the first surface 100 is provided with a glue 13.

Figure 8:
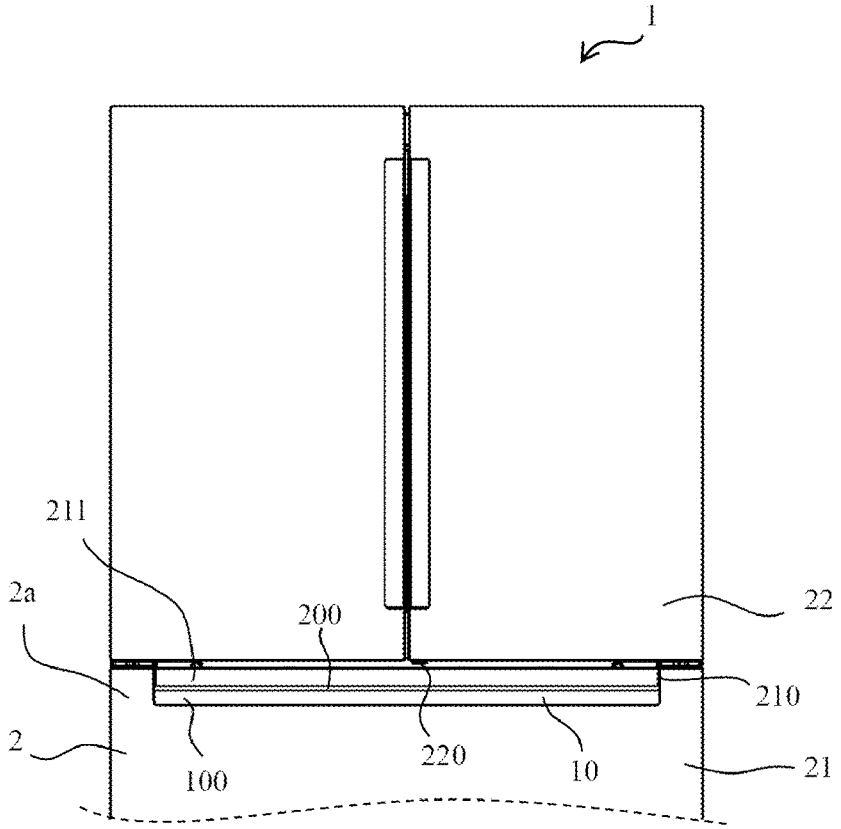
FIG. 8 is a diagrammatic, partial view of a household appliance according to an embodiment of the invention.

Next, an embodiment of the invention relating to a household appliance is introduced. Referring to FIG. 8, it is seen that FIG. 8 is a diagrammatic, partial view of a household appliance according to an embodiment of the invention.

The household appliance of this embodiment is a refrigerator. The household appliance 1 includes a panel 2 located in the front of the household appliance 1 and a metal member 10 described in the above embodiment. The metal member 10 is disposed on an edge area of the panel 2, and the metal member 10 extends along at least one edge of the panel 2.

Figure 9:
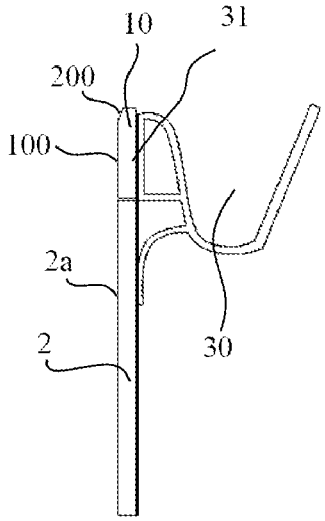
FIG. 9 is a partial cross-sectional view of a household appliance according to an embodiment of the invention.

The panel 2 has a notch 210 matching an outer contour of the metal member 10, where the metal member 10 is embedded in the notch 210. Therefore, the metal member 10 fills up part of the notch 210 so that the other part of the notch 210 forms an opening 211 for a person to put a hand into. A person puts a hand into the notch 210 through the opening 211 to hold a grip portion 31, so as to open or close a door. The metal member 10 is disposed on the grip portion 31. Reference is made to FIG. 9 for details of a related structure.

FIG. 9 is a partial cross-sectional view of a household appliance according to an embodiment of the invention. The household appliance 1 includes a handle slot 30 and the grip portion 31 located on a front side of the handle slot 30. The metal member 10 is located at the grip portion 31 and extends along the handle slot 30, and the second surface 200 is closer to the handle slot 30 than the first surface 100.

The first surface 100 extends in a direction perpendicular to a horizontal plane, that is, the first surface 100 extends vertically. The first surface 100 is flush with a front surface 2*a* of the panel 2.

The second surface 200 is inclined backward from the first surface 100. To be specific, the second surface 200 is inclined backward and upward from the first surface 100 (shown in FIG. 9). Therefore, the second surface 200 is closer to the handle slot 30 than the first surface 100. Such a configuration enables the second surface 200 to better reflect light to form an elongated bright strip, so as to prompt the position of the handle slot 30 to the user. Because the grip portion 31 is located in the front of the handle slot 30, the handle slot 30 is shielded.

Referring to FIG. 8 again, in an embodiment of the invention, the household appliance 1 further includes a light emitting module 220, where the metal member 10 is disposed close to the light emitting module 220 so that the second surface 200 is adapted for reflecting light emitted from the light emitting module 220. The second surface 200 is closer to the light emitting module 220 than the first surface 100 is. Therefore, the second surface 200 may be brighter.

In this embodiment, the household appliance 1 includes a first door 21 and a second door 22 adjacent to each other, where the metal member 10 is disposed along a side of the first door 21 close to the second door 22. The second door 22 is provided with a light emitting module 220 on a side thereof close to the first door 21, and the second surface 200 is closer than the first surface 100 to the second door 22. In this way, the possibility that light is blocked from arriving at the second surface 200 is reduced, thereby improving the brightness of the second surface 200.

Figure 10:
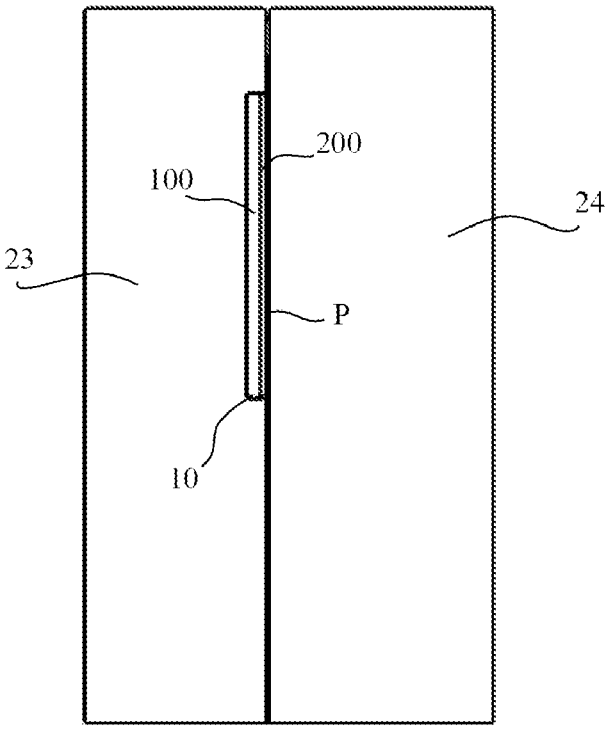
FIG. 10 is a diagrammatic view of a household appliance according to another embodiment of the invention.

In another embodiment of a household appliance of the invention, as shown in FIG. 10, it is seen that FIG. 10 is a diagrammatic view of a household appliance according to another embodiment of the invention. The household appliance 1 includes a third door 23 and a fourth door 24 adjacent to each other. One of the third door 23 and the fourth door 24 is configured to uncover or cover a refrigerating space, and the other one of the third door 23 and the fourth door 24 is configured to uncover or cover a freezing space. In this embodiment, the third door 23 is configured to uncover or cover the freezing space, and the fourth door 24 is configured to uncover or cover the refrigerating space. The metal member 10 is disposed along a side of the third door 23 close to the fourth door 24, and the second surface 200 is closer than the first surface 100 to the fourth door 24. Therefore, a bright light effect formed by the metal member 10 visually distinguishes the refrigerating space and the freezing space.

In this embodiment, a gap P is formed between the third door 23 and the fourth door 24. The metal member 10 is disposed along a side of the third door 23 close to the gap P, and the second surface 200 is closer than the first surface 100 to the gap P. The gap P forms a dark area, which produces a contrast against the second surface 200, to make the bright light effect of the second surface 200 more prominent.

Figure 11:
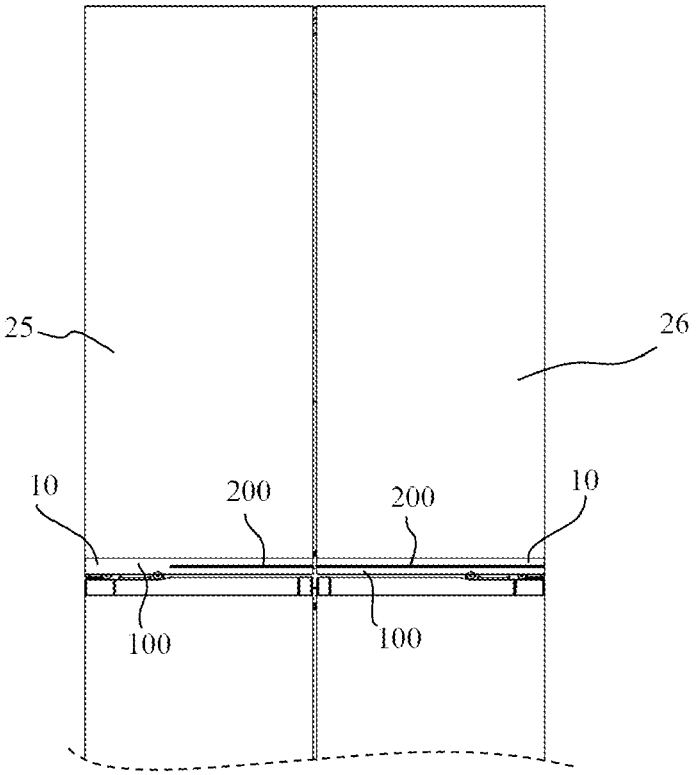
FIG. 11 is a diagrammatic, partial view of a household appliance according to another embodiment of the invention.

Referring to FIG. 11, it is seen that FIG. 11 is a diagrammatic, partial view of a household appliance according to another embodiment of the invention.

The household appliance 1 includes a fifth door 25 and a sixth door 26 adjacent to each other, where one metal member 10 is disposed on a bottom side of the fifth door 25, and one metal member 10 is disposed on a bottom side of the sixth door 26. The second surface 200 of the metal member 10 disposed on the fifth door 25 extends along a partial length of the metal member 10. The second surface 200 of the metal member 10 disposed on the sixth door 26 extends along the entire length of the metal member 10.

Moreover, the metal member 10 disposed on the fifth door 25 and the metal member 10 disposed on the sixth door 26 are flush with each other so that the second surfaces 200 extend in the same direction. Therefore, in terms of the visual effect, the bright light effect formed by the second surface 200 extends from the bottom side of the fifth door 25 to the bottom side of the sixth door 26.

As can be seen from the embodiments shown in FIG. 8 to FIG. 11, the metal member 10 is disposed on a middle part and/or an upper part of the door.

Various embodiments of individual components illustrated with reference to FIG. 1 to FIG. 11 may be combined with each other in any given manner to realize the advantages of the invention.

The invention has been described by the foregoing related embodiments, but the foregoing embodiments are only examples for implementing the invention. It is to be pointed out that the disclosed embodiments do not limit the scope of the invention. On the contrary, changes and modifications made without departing from the spirit and scope of the invention fall within the protection scope of the invention.

The following is a summary list of reference numerals and the corresponding structure used in the above description of the invention:

1—household appliance;
2—panel;
2*a*—front surface;
10—metal member;
11—groove;
12—mark;
13—glue;
21—first door;
22—second door;
23—third door;
24—fourth door;
25—fifth door;
26—sixth door;
30—handle slot;
31—grip portion;
100—first surface;
200—second surface;
200*a*, 200*b*—sub-surface;
210—notch;
211—opening;
220—light emitting module;
P—gap.

The invention claimed is:

1. A metal member for a household appliance, the metal member comprising:
a first surface and a second surface being connected to each other;
said second surface being inclined relative to said first surface, and said second surface having a reflectivity higher than a reflectivity of said first surface;
said second surface extending in an edge area of the metal member along a length direction of the metal member.

2. The metal member according to claim 1, which further comprises a groove extending along a length direction of the metal member, said second surface being located in said groove.

3. The metal member according to claim 2, wherein said second surface includes two sub-surfaces in mirror symmetry with each other.

4. The metal member according to claim 3, wherein said two sub-surfaces form an angle of 120° between said two sub-surfaces.

5. The metal member according to claim 2, which further comprises a mark disposed on said first surface, said mark being disposed on one side of one end of said groove and said groove extending toward said mark.

6. The metal member according to claim 1, wherein a surface roughness of said second surface is less than a surface roughness of said first surface, said surface roughness of said second surface is not greater than 0.4 μm, and said surface roughness of said first surface is greater than 0.1 mm.

7. The metal member according to claim 1, wherein the metal member is elongated, said first surface extends along an entire length of the metal member, and said second surface extends along an entire or partial length of the metal member.

8. A household appliance, comprising:
a front of the household appliance;
a panel located at said front of the household appliance, said panel having an edge area and at least one edge;
a metal member including a first surface and a second surface being connected to each other;
said second surface being inclined relative to said first surface, and said second surface having a reflectivity higher than a reflectivity of said first surface;
said metal member being disposed on said edge area of said panel; and
said metal member extending along said at least one edge of said panel.

9. The household appliance according to claim 8, wherein said panel has a notch matching an outer contour of said metal member, and said metal member is embedded in said notch.

10. A household appliance, comprising:
a metal member including a first surface and a second surface being connected to each other;
said second surface being inclined relative to said first surface, and said second surface having a reflectivity higher than a reflectivity of said first surface;
said first surface extending in a direction perpendicular to a horizontal plane, and said second surface being inclined backward from said first surface.

11. The household appliance according to claim 8, wherein said panel has a front surface, and said first surface is flush with said front surface of said panel.

12. The household appliance according to claim 8, which further comprises a light emitting module, said metal member being disposed close enough to said light emitting module to permit said second surface to be adapted for reflecting light emitted from said light emitting module.

13. The household appliance according to claim 12, wherein said second surface is closer than said first surface to said light emitting module.

14. The household appliance according to claim 8, which further comprises:
a first door and a second door being adjacent to each other;
said metal member being disposed along a side of said first door in a vicinity of said second door;
said second door being provided with a light emitting module on a side of said second door in a vicinity of said first door; and
said second surface being closer than said first surface to said second door.

15. The household appliance according to claim 8, which further comprises:
a third door and a fourth door being adjacent to each other and defining a gap between said third door and said fourth door;
said metal member being disposed along a side of said third door in a vicinity of said gap; and said second surface being closer than said first surface to said gap.

16. The household appliance according to claim 8, which further comprises:

a fifth door and a sixth door being adjacent to each other;

said metal member being disposed on said fifth door;

another metal member being disposed on said sixth door and having first and second surfaces; and said metal member disposed on said fifth door and said metal member disposed on said sixth door being flush with each other causing said second surfaces of said fifth and sixth doors to extend in an identical direction.

17. The household appliance according to claim 8, which further comprises:

a handle slot having a front side;

a grip portion located on said front side of said handle slot;

said metal member being located at said grip portion and extending along said handle slot; and said second surface being closer than said first surface to said handle slot.

18. The household appliance according to claim 8, which further comprises a door extending along a vertical direction and having a middle part and an upper part, said metal member being disposed on at least one of said middle part or said upper part of said door.

* * * * *